US006871604B2

(12) United States Patent
Alexakis et al.

(10) Patent No.: US 6,871,604 B2
(45) Date of Patent: Mar. 29, 2005

(54) CONVERSION OF WASTE INTO HIGHLY EFFICIENT FUEL

(75) Inventors: Theodora Alexakis, Montreal (CA); Jon Williams Cofield, Washington, MD (US); Platon Manoliadis, Montreal (CA); Eugene Ellis Nolting, Columbia, MD (US); Peter George Tsantrizos, Montreal (CA); Roy V. Richard, Natick, MA (US)

(73) Assignees: Pyrogenesis, Inc., Montreal (CA); The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/259,547

(22) Filed: Sep. 27, 2002

(65) Prior Publication Data

US 2004/0060488 A1 Apr. 1, 2004

(51) Int. Cl.[7] ..... F23B 7/00; F23G 5/003; F23D 1/00; F23K 1/00

(52) U.S. Cl. ..... 110/342; 110/346; 110/347; 110/232; 110/221

(58) Field of Search ..... 110/232, 221, 110/250, 342, 346, 347

(56) References Cited

U.S. PATENT DOCUMENTS

| | | | | | |
|---|---|---|---|---|---|
| 3,159,353 | A | * | 12/1964 | Atwater | 241/39 |
| 3,622,508 | A | * | 11/1971 | Komline | 210/9 |
| 3,670,669 | A | * | 6/1972 | Hoad | 110/8 R |
| 4,089,628 | A | * | 5/1978 | Blackburn | 431/6 |
| 4,121,524 | A | | 10/1978 | Voelskow et al. | |
| 4,123,489 | A | | 10/1978 | Kelley | |
| 4,133,273 | A | * | 1/1979 | Glennon | 110/346 |
| 4,147,116 | A | * | 4/1979 | Graybill | 110/263 |
| 4,475,922 | A | * | 10/1984 | Rich | 44/1 C |
| 4,553,977 | A | | 11/1985 | Fry | |
| 4,589,356 | A | * | 5/1986 | Adams et al. | 110/347 |
| 4,589,357 | A | * | 5/1986 | Lincoln et al. | 110/347 |
| 4,750,436 | A | * | 6/1988 | Maury et al. | 110/346 |
| 4,750,437 | A | | 6/1988 | Rouse | |
| 4,763,585 | A | * | 8/1988 | Rickman et al. | 110/346 |
| 4,798,342 | A | * | 1/1989 | Williams | 241/18 |
| 5,586,729 | A | | 12/1996 | Davenport | |
| 5,862,762 | A | * | 1/1999 | Sekiguchi et al. | 110/346 |
| 5,960,026 | A | * | 9/1999 | Nolting et al. | 373/24 |
| 6,045,070 | A | | 4/2000 | Davenport | |
| 6,376,739 | B1 | | 4/2002 | Laflamme et al. | |

FOREIGN PATENT DOCUMENTS

| | | |
|---|---|---|
| DE | 19513538 | 10/1996 |
| DE | 10012183 | 9/2001 |
| EP | 0682965 | 11/1995 |
| EP | 1162405 | 12/2001 |
| WO | PCT/CA 03/01471 | 7/2004 |

* cited by examiner

*Primary Examiner*—Kenneth Rinehart
(74) *Attorney, Agent, or Firm*—James R. Frederick; Van Der Sluys & Adolphson LLP

(57) ABSTRACT

Solid combustible waste materials are converted into highly efficient fuel by subjecting such materials to size reduction in suitable size-reducing equipment. The last piece of the equipment is a mill which pulverizes the waste materials into fine particles having a high surface to mass ratio and forming a highly efficient fuel when these particles are directly injected into a combustion reactor operating at high temperature.

22 Claims, 3 Drawing Sheets

CONVERSION OF WASTE INTO HIGHLY EFFICIENT FUEL

FIELD OF THE INVENTION

This invention relates to a method and an apparatus for converting solid combustible waste materials, such as paper, cardboard, food, plastics, textiles, wood and the like, into fine particles which form a highly efficient fuel when fed directly into a combustion reactor, particularly such as a plasma arc waste destruction furnace.

BACKGROUND OF THE INVENTION

Typically, combustible solid waste is introduced into a thermal treatment furnace, such as an incinerator, in its original form or after being reduced in size by a shredder-type device. The moisture content of the waste particles is usually "as-received" and the smallest practical size achieved by a conventional shredder is several centimeters.

Efforts have also been made in the past to convert waste materials, such as waste paper products, into useful forms, including fuel. One such method is disclosed in U.S. Pat. No. 4,123,489 where paper waste is processed by a rotary cutter which includes a knife cylinder having a plurality of blades for cutting the waste paper products fed into the machine into smaller pieces or particles. The cutter includes a recutter screen having a surface cooperating with the periphery of the rotating knife cylinder, providing sizing openings for further reducing the size of the pieces of paper waste. The pieces passing through the recutter screen are cut to a maximum of ⅛ inch by 2 inches which makes the material suitable for various purposes, including feeding into the die cavity of a pelletizing machine to form high quality, relatively dust-free pellets of paper material, that can be used as a fuel. Such pellets, however, do not constitute a very efficient fuel since their surface to mass ratio is not very high.

There is thus a need for the conversion of solid combustible waste into a highly efficient fuel that can be readily used, for example, in a plasma fired eductor or any other combustion reactor.

OBJECTS AND SUMMARY OF THE INVENTION

It is an object of the present invention to provide a method and an apparatus for the conversion of combustible waste into highly efficient fuel.

It is a further object to provide a solid fuel stream from such waste, which will easily burn in a plasma furnace or other combustion reactor or incinerator.

Other objects and advantages of the invention will be apparent from the following description thereof.

The invention, reported herein, is based on the concept of converting waste into a fuel for efficient combustion in a thermal treatment system. A fuel, for the purpose of this invention, is defined as a combustible material which has been milled to dramatically increase its surface area to mass ratio and dried to a moisture content of less than 5% by weight.

The waste treatment system of the present invention subjects combustible waste, which includes materials such as paper, cardboard, food, plastics, textiles and wood, to size reducing steps achieved by suitable size reducing equipment leading to a finely pulverized product. The final pulverized product is in the form of fine particles or fibers having a high surface to mass ratio Such particles, which usually have a diameter of 15 $\mu$m or less, are fed pneumatically to a desired type of combustion reactor without any intermediate transformation into pellets or the like. This direct conveying of the fine particles into a combustion reactor, such as an incinerator or a waste treatment furnace, or a high-efficiency plasma-fired eductor of a plasma arc waste destruction system, allows them to gasify rapidly when exposed to the high heat of the reactor (about 1000° C. or higher), thus significantly increasing combustion efficiency.

In essence, in accordance with the present invention, a stream of solid combustible waste is converted into a solid fuel stream consisting of finely pulverized waste material which is then fed into a combustion reactor operating at high temperature adapted to rapidly gasify the finely pulverized material.

BRIEF DESCRIPTION OF THE DRAWINGS

The invention will be further described with reference to the appended drawings in which.

DETAILED DESCRIPTION

Figure 1:
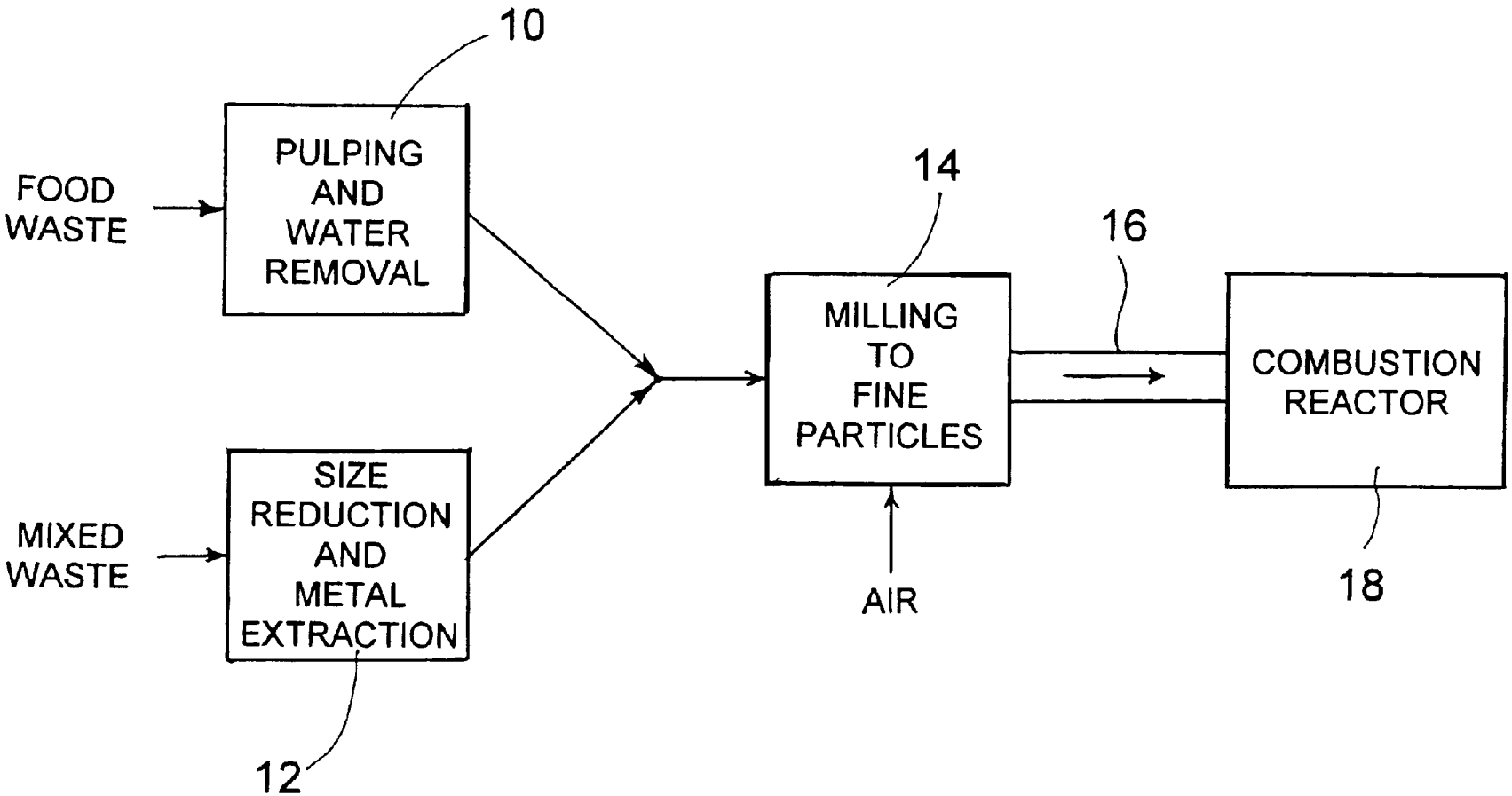
FIG. 1 is a schematic block diagram illustrating the operation of an embodiment of the present invention.

A preferred embodiment of the invention is illustrated in FIG. 1. According to this embodiment, waste can be subjected at 10 to pulping followed by water removal and/or at 12 to shredding followed by metal extraction. Pulping, mainly of food waste, is carried out in a pulper where the size of the particles is reduced to a size suitable for milling into fine particles, which is usually to less than ½ cm. Following the pulper, water is removed to yield an extracted pulped product containing a predetermined amount of solids, e.g. approximately 50% solids, by weight.

Mixed waste, including paper, cardboard, food, plastic, wood and textile wastes, is subjected at 12 to size reduction and extraction of any metal that may be present in such waste. This can be done, for instance, in a shredder where the size of such waste is reduced to small pieces suitable for milling into fine particles, for example of about 2.5 cm in size.

Once the waste materials have been reduced at 10 and/or 12 to a size suitable for milling, they are subjected to milling at 14 where the size of the waste is pulverized to fine fibers or particles, preferably having a diameter of about 15 $\mu$m or less, and the moisture content is reduced in the mill from about 50% to less than 5% by weight, which represents an essentially dry condition. Such fine particles have a high surface to mass ratio and form a highly efficient fuel. Air is added to the mill to act as a carrier for the pulverized waste which can then be pneumatically fed through conduit 16 to a combustion reactor 18, which can be an incinerator, a plasma treatment furnace, a plasma fired eductor, or the like.

Figure 2:
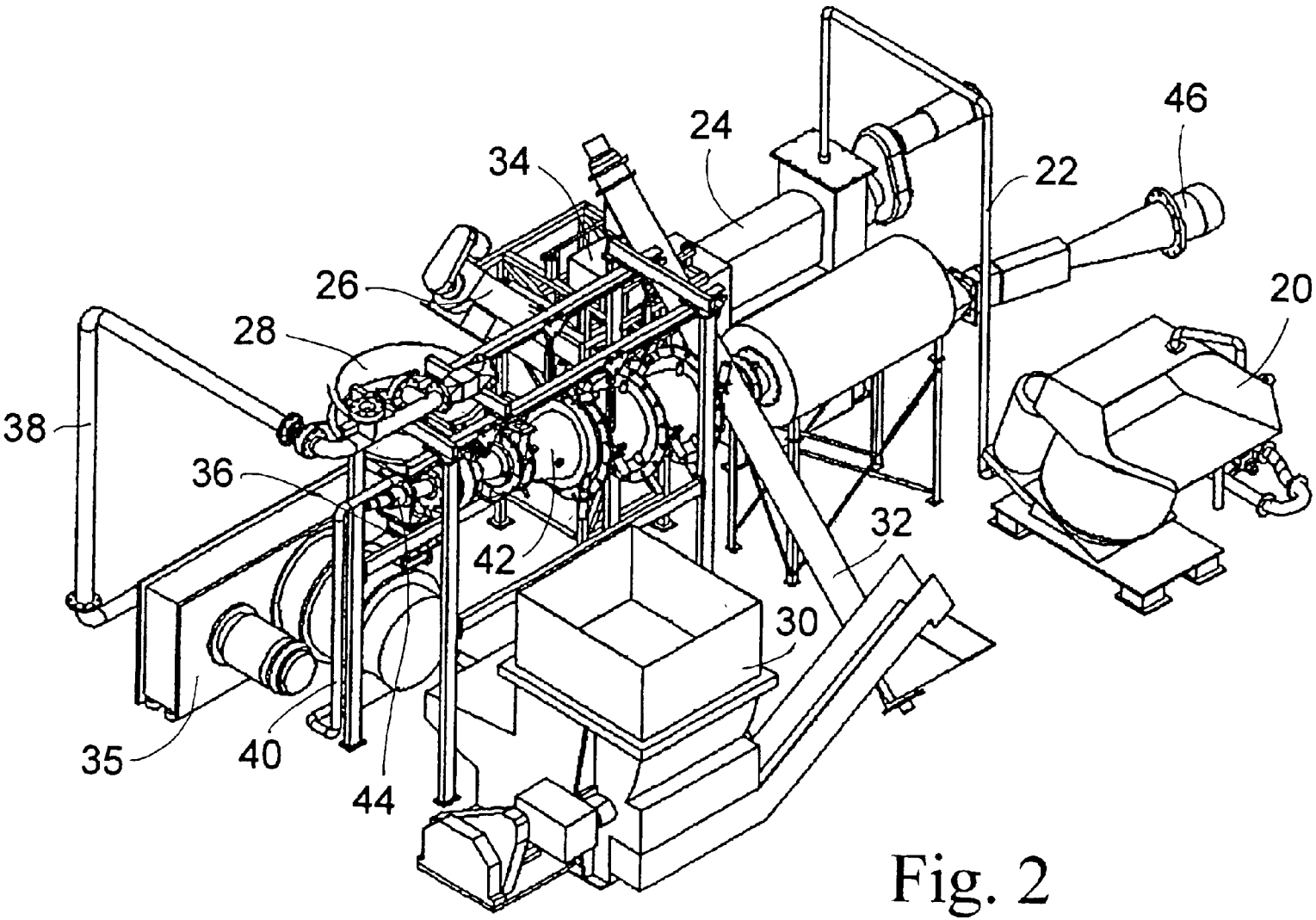
FIG. 2 is a perspective view of equipment used within the apparatus producing the operation illustrated in FIG. 1.

FIG. 2 illustrates the equipment suitable for the purposes of the present invention. Pulper 20 is provided to treat primarily food waste, but which may also contain some paper, cardboard and other pulpable materials. In this pulper, the waste is normally reduced to a size of less than 0.5 cm and the slurry exiting the pulper by conduit 22 and containing approximately 1% by weight of solids, enters a water extractor 24 where water is removed by mechanical means to yield a product in the from of pressed pulp that contains approximately 50% solids by weight. This pressed pulp is then fed onto conveyor 26 and from this conveyor to a hopper/mixer 28 where it is kept in admixture with other waste materials coming from a shredder 30.

Mixed waste, which may contain paper, cardboard, food, plastics, wood and textiles, is fed into the shredder 30 where its size is reduced to a degree suitable for milling into fine particles, for example in the neighbourhood of 2.5 cm. Such shredded waste is then conveyed via a suitable conveyor 32 to a metal extractor 34 which eliminates any metallic matter that may have been present in such waste. This can be done by passing the shredded waste through a suitable screen that will catch larger metallic pieces as well as by using magnets to remove magnetic materials and other suitable means. From the metal extractor 34, the shredded waste is fed to the conveyor 26 to be mixed with pressed pulp. This conveyor 26 is normally an auger with cut and folded flights which mixes the material as it is conveyed to the hopper/mixer 28. The mixed waste is metered from the hopper/mixer 28 into a mill 35 via a rotary valve 36. In the mill 35, the size of the waste is reduced to fine fibers or particles, preferably of about 15 $\mu$m or less in diameter and the moisture content is reduced from about 50% to about 4% by weight. The mechanical work performed by the mill 35 in pulverizing the waste, also performs the drying of the waste. Air is added to the mill 35 via conduit 38 to act as a carrier for the pulverized waste which is then fed pneumatically via conduit 40 to a combustion reactor 42. In this case, the combustion reactor 42 consists of a plasma arc waste destruction system and the pulverized waste is fed into the plasma-fired eductor 44 at the inlet thereof. The pulverized waste is fully combusted in this system to produce $CO_2$ and $H_2O$ at the outlet 46.

Figure 3:
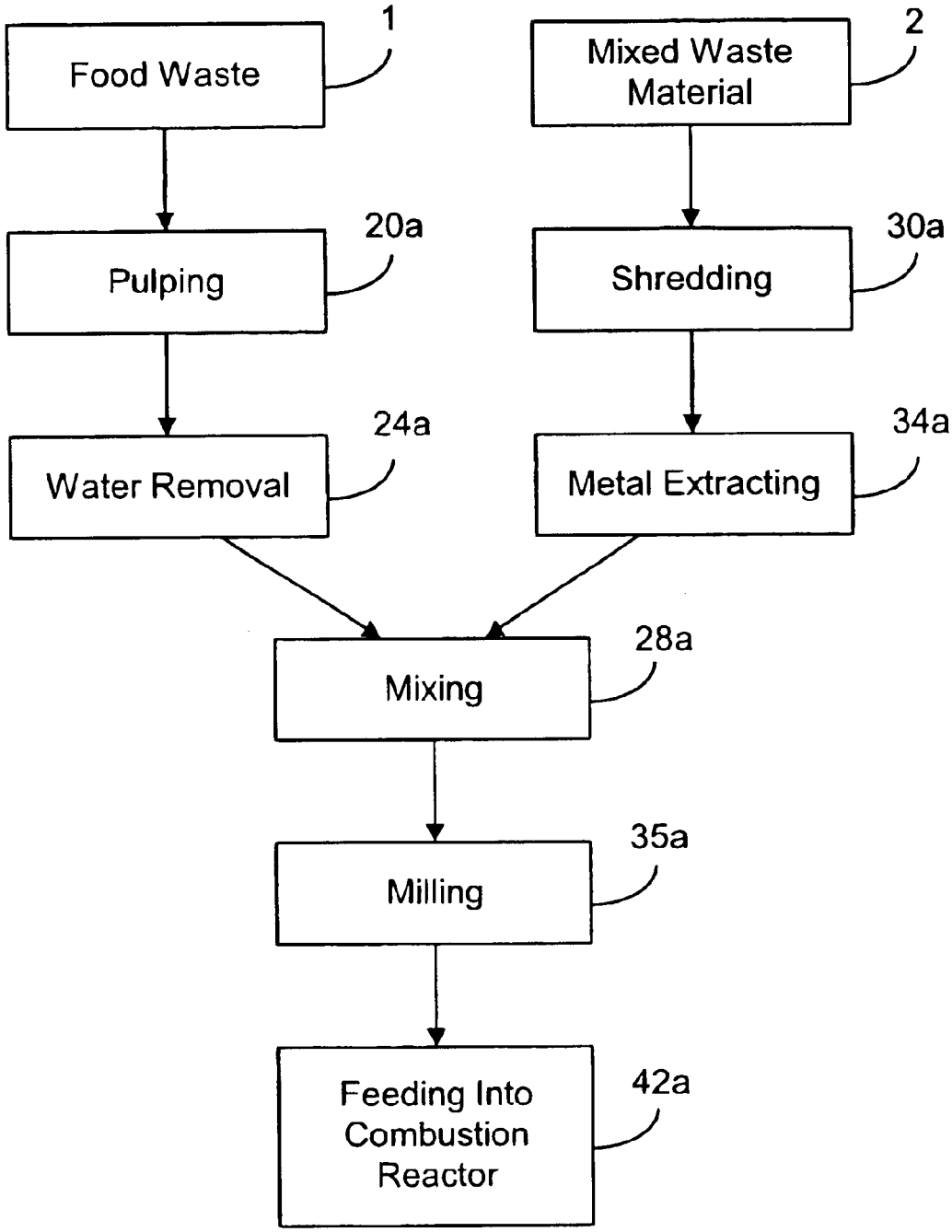
FIG. 3 is a schematic block diagram, also illustrating the operation of the embodiment of the present invention.

The foregoing is also illustrated in FIG. 3, wherein food waste 1 is subject to pulping as indicated at 20*a* and water removal as indicated at 24*a*, and mixed waste 2 is subject to shredding as indicated at 30*a* and metal extraction as indicated at 34*a*. The pulped food waste and shredded mixed waste are subjected to mixing as indicated at 28*a*, and thereafter to milling as indicated at 35*a*. The next step is feeding the milled waste into a combustion reactor, as indicated at 42*a*.

The invention is not limited to the specific embodiments described above, and includes various modifications obvious to those skilled in the art, without departing from the scope of the following claims.

What is claimed is:

1. Method of converting solid combustible waste materials into fuel, which comprises subjecting the waste materials to size reducing steps of which the last step comprises a milling operation which pulverizes the waste materials into fine particles having a high surface to mass ratio and forming a fuel, and pneumatically feeding said fine particles into a combustion reactor operating at high temperature adapted to rapidly gasify said particles, and in which primarily food waste is subjected in a size-reducing step to pulping, followed by water removal to produce a pulped product having a particle size suitable for milling into fine particles, and mixed waste is subjected in a separate size-reducing step to shredding, followed by metal extraction of any fugitive metallic materials, to produce a shredded, metal-free product of a size suitable for milling into fine particles, said pulped product and said shredded metal-free product are then intermixed and their mixture is subjected to the milling operation to produce essentially dry fine particles having a high surface to mass ratio and forming a fuel, which particles are then directly fed into the combustion reactor.

2. Method of converting solid combustible waste materials into fuel, wherein the waste materials include food, paper, cardboard, plastic and textiles, comprising the steps of:

A) shredding mixed waste comprising paper, cardboard, plastics and textiles and thereafter extracting metal from the shredded mixed waste, to produce metal-free shredded mixed waste of a size suitable for milling into fine particles;

B) pulping food waste and thereafter removing water from the pulped food waste, to produce particles of pulped food waste of a particle size suitable for milling into fine particles;

C) pulverizing the shredded metal-free waste and the particles of pulped food waste by a milling operation to form fine fuel particles having a high surface to mass ratio; and D) pneumatically feeding said fine particles into a combustion reactor operating at high temperatures adapted to rapidly gasify said fine fuel particles.

3. Method according to claim 2 wherein the combustion reactor is chosen from the group consisting of a plasma furnace and a plasma-fired eductor of a plasma waste destruction system.

4. Method according to claim 2, in which primarily food waste is subjected in a size-reducing step to pulping, followed by water removal to produce a pulped product having a particle size suitable for milling into fine particles, and mixed waste is subjected in a separate size-reducing step to shredding, followed by metal extraction of any fugitive metallic materials, to produce a shredded, metal-free product of a size suitable for milling into fine particles, wherein said particles of said pulped food waste and said particles of shredded metal-free mixed waste are then intermixed and their mixture is subjected to the milling operation to produce essentially dry fine particles having a high surface to mass ratio and forming a fuel, which essentially dry fine particles are then directly fed into the combustion reactor.

5. Method according to claim 4, wherein the combustion reactor is chosen from the group consisting of a plasma furnace and a plasma-fired eductor of a plasma waste destruction system.

6. Method according to claim 2, in which the milling operation is adapted to pulverize the shredded mixed waste and pulped food waste to a particle size of 15 $\mu$m or less in diameter.

7. Method according to claim 6, wherein the combustion reactor is chosen from the group consisting of a plasma furnace and a plasma-fired eductor of a plasma waste destruction system.

8. Apparatus for converting solid combustible waste materials into fuel, which comprises first suitable size of reducing equipment for reducing the size of food waste, second suitable size reducing equipment for reducing the size of mixed waste, a mill capable of pulverizing the reduced-size food waste and reduced size mixed waste into fine particles having a high surface to mass ratio and forming a fuel, means for intermixing the reduced size food waste and the shredded reduced size mixed waste prior to feeding them into the mill, and means for pneumatically transferring said fine particles directly into a combustion reactor.

9. Apparatus as claimed in claim 8, in which said size reducing equipment for food waste, used prior to the mill, comprises a pulper where a slurry is formed and the size of the waste material is reduced to a particle size suitable for milling.

10. Apparatus as claimed in claim 9, and further comprising a water extractor and means for feeding said slurry into said water extractor in which water is removed to achieve a pulped material having a predetermined amount of solids.

11. Apparatus according to claim 8, in which initial size reducing equipment for mixed waste, used prior to the mill, comprises a shredder where the size of the mixed waste is reduced to a degree suitable for milling into fine particles.

12. Apparatus according to claim 11, and further comprising a metal extractor for removing any fugitive metallic pieces, and means for passing shredded reduced size mixed waste through the metal extractor after said shredded reduced size mixed waste exits the shredder.

13. Apparatus according to claim 8, in which means are provided for injecting air into the mill so as to allow transfer of the fine particles produced in the mill by pneumatic means into a combustion reactor.

14. Apparatus according to claim 8, in which the combustion reactor is chosen from the group consisting of a plasma furnace and a plasma-fired eductor of a plasma waste destruction system.

15. Apparatus for converting solid combustible waste materials into fuel, which comprises first suitable size reducing equipment for reducing the size of food waste, second suitable size reducing equipment for reducing the size of mixed waste, a mill capable of pulverizing the reduced size food waste and reduced size mixed waste into fine particles having a high surface to mass ratio and forming a fuel, the mill adapted to mill the reduced size food waste and the shredded reduced size mixed waste to form essentially dry particles of a size of about 15 $\mu$m or less in diameter, and means for pneumatically transferring said fine particles directly into a combustion reactor.

16. Apparatus as claimed in claim 15, in which said size reducing equipment for food waste, used prior to the mill, comprises a pulper where a slurry is formed and the size of the waste material is reduced to a particle size suitable for milling.

17. Apparatus as claimed in claim 16, and further comprising a water extractor and means for feeding said slurry into said water extractor in which water is removed to achieve a pulped material having a predetermined amount of solids.

18. Apparatus according to claim 15, in which initial size reducing equipment for mixed waste, used prior to the mill, comprises a shredder where the size of the mixed waste is reduced to a degree suitable for milling into fine particles.

19. Apparatus according to claim 18, and further comprising a metal extractor for removing any fugitive metallic pieces and means for passing shredded reduced size mixed waste through the metal extractor after said shredded reduced size mixed waste exits the shredder.

20. Apparatus according to claim 15, further comprising means for intermixing the reduced size food waste and the shredded reduced size mixed waste prior to feeding them into the mill.

21. Apparatus according to claim 15, in which means are provided for injecting air into the mill so as to allow transfer of the fine particles produced in the mill by pneumatic means into a combustion reactor.

22. Apparatus according to claim 15, in which the combustion reactor is chosen from the group consisting of a plasma furnace and a plasma-fired eductor of a plasma waste destruction system.

* * * * *